US008857024B2

(12) United States Patent
Goedken et al.

(10) Patent No.: US 8,857,024 B2
(45) Date of Patent: Oct. 14, 2014

(54) LOAD LEVELING MODIFICATION FOR FRONT LOADING REFUSE TRUCK

(75) Inventors: Kenneth D. Goedken, Dubuque, IA (US); Marlin L. Johnson, Guttenberg, IA (US); Jared L. Rowland, Dyersville, IA (US)

(73) Assignee: Kann Manufacturing Corporation, Guttenberg, IA (US)

( * ) Notice: Subject to any disclaimer, the term of this patent is extended or adjusted under 35 U.S.C. 154(b) by 233 days.

(21) Appl. No.: 13/563,382

(22) Filed: Jul. 31, 2012

(65) Prior Publication Data

US 2013/0034412 A1 Feb. 7, 2013

Related U.S. Application Data

(60) Provisional application No. 61/513,831, filed on Aug. 1, 2011.

(51) Int. Cl.

| | |
|---|---|
| ***B21K 21/16*** | (2006.01) |
| ***B65F 3/06*** | (2006.01) |
| ***B65F 3/04*** | (2006.01) |
| *B65F 3/02* | (2006.01) |

(52) U.S. Cl.

CPC ..... *B65F 3/043* (2013.01); *B65F 2003/0279* (2013.01)

USPC ..... 29/401.1; 414/408

(58) Field of Classification Search

CPC .. B65F 3/043; B65F 2003/0279; B65F 66/00; B60P 1/00; B60P 1/02; B60P 1/04; B60P 1/48

USPC ..... 29/401.1, 428, 525.01, 525.14, 469; 414/408, 406, 405, 403

See application file for complete search history.

(56) References Cited

U.S. PATENT DOCUMENTS

| | | | | |
|---|---|---|---|---|
| 3,827,587 | A * | 8/1974 | Liberman et al. | 414/420 |
| 4,085,857 | A | 4/1978 | Smith | |
| 4,091,944 | A | 5/1978 | Gollnick | |
| 4,278,390 | A | 7/1981 | Ahearn | |
| 4,647,267 | A | 3/1987 | Hund, Jr. | |
| 6,152,673 | A * | 11/2000 | Anderson et al. | 414/408 |

OTHER PUBLICATIONS

International Search Report dated Jan. 28, 2013 from co-pending PCT application.

* cited by examiner

*Primary Examiner* — John C Hong

(74) *Attorney, Agent, or Firm* — Allan L. Harms; Brett D. Papendick; Shuttleworth & Ingersoll, PLC

(57) ABSTRACT

A modification apparatus to convert an existing front loading refuse collection truck so that the lifted container remains level until the container is near the load opening of the refuse collection body of the truck. A mounting plate is bolted to brackets added to an existing refuse collection body and provides multiple connection points for attachment of one end of a slave cylinder that is hinged at its other end to one of the main lift arms of the collection body. As the rod of the slave cylinder extends or retracts with the movement of the lift arm, hydraulic fluid from the slave cylinder passes to fork cylinders which retract or extend to control the orientation of the lifted container relative to the lift arms. The apparatus can be easily added to a variety of existing front loading collection bodies.

16 Claims, 3 Drawing Sheets

LOAD LEVELING MODIFICATION FOR FRONT LOADING REFUSE TRUCK

CROSS REFERENCE TO RELATED APPLICATIONS

This application claims priority under 35 USC §119 from copending provisional patent application entitled LOAD LEVELING MODIFICATION FOR FRONT LOADING REFUSE TRUCK, Ser. No. 61/513,831, filed Aug. 1, 2011. The disclosures of provisional patent application Ser. No. 61/513,831 are hereby incorporated in their entireties.

BACKGROUND

Many refuse collection trucks are in use today of which a large percentage are front loading trucks which generally have a pair of forks attached to lift arms which raise a refuse container from the ground in front of the truck, over the truck cab, to a tipped position over the load opening of the refuse collection body. The load opening of a front loading refuse truck is located at the top of the collection body such that commodity in the refuse container will fall from the container into the load opening.

Currently, most front loading refuse trucks do not automatically operate to maintain an upright orientation of the lifted container as it is lifted on the lift arms. Instead the lift arms rotate about pivots on the refuse body and the lifted container moves from upright at ground level to substantially rotated by ninety degrees at the dump position above the load opening of the truck. Unless the operator intervenes to adjust the angle of the pickup forks on the lift arms, the container continuously rotates as it is moved from ground position to the dump position. As the lifted container rotates toward having its top become vertical, the opportunity increases for refuse commodity to prematurely fall from the container before it is positioned above the load opening.

Modern front loading trucks include hydraulic cylinders on the lift arms which can orient the forks of the arms and the operator then has manual control of the orientation of the lifted container by adjusting the extension of the rods on the hydraulic cylinders. The truck operator must activate a control to retract these cylinders when the container is at the dump position so that the container will tip sufficiently to empty into the load opening.

Some developments have led to leveling apparatus which operates through electronic means to maintain the lifted container in a generally upright orientation before it is located over the load opening. However, typically, leveling the lifted container requires the truck operator to manually control the cylinders on the lift arms by operation of extra levers or other controls.

An inexpensive modification is needed to retrofit existing front end loading refuse trucks to allow for automatic container leveling without operator intervention until the container is ready to be emptied.

SUMMARY OF THE INVENTION

The present invention provides modification apparatus to convert an existing front loading refuse collection truck to provide an automatic leveling feature so that the lifted container remains level until the container is near the load opening of the refuse collection body of the truck. The apparatus operates by hydraulic fluid movement and requires no electronic controls or operator intervention to carry out proper container leveling. A slave cylinder mounted along a side of the collection truck body with one end joined to the body exterior and the other end connected to one of the lift arms can hydraulically control the orientation of the lifted container relative to the lift arms as the container is lifted. Use of the apparatus improves the performance of the front loading collection body by reducing the need for operator involvement to reduce the incidence of commodity prematurely falling from the container. This hydraulic load leveling apparatus avoids the costs associated with electronic control systems by eliminating the need for required electronic sensors and controllers and avoiding the costs associated with maintenance of such sensors and controllers in the harsh environment of a commodity collection truck. The apparatus can be retrofitted on an existing front loading collection body with little change to the body and various sizes and styles of front loading collection body can be modified with the same general apparatus.

It is therefore a primary object of the invention to provide a straight forward retrofit apparatus which requires few modifications to a typical front loading commodity collection body to allow installation of apparatus which passively maintains a horizontal orientation of a container lifted by lift arms of the body until the container reaches the load opening at which time it is tipped substantially to allow its contents to fall into the load opening of the collection body.

It is a further object of the invention to provide a system which automatically maintains a level orientation of a container carried on the lift arms of a front loading commodity collection body as the container is lifted to the dumping position, without incurrence of the expenses of installation and maintenance of electronic sensors to measure the orientation and electronic controllers to modify the orientation in response to sensor outputs.

It is yet a further object to provide an inexpensive apparatus to provide a commodity collection body which does not require operator intervention to prevent premature tipping of a container carried on the lift arms of the collection body.

DETAILED DESCRIPTION

Figure 1:
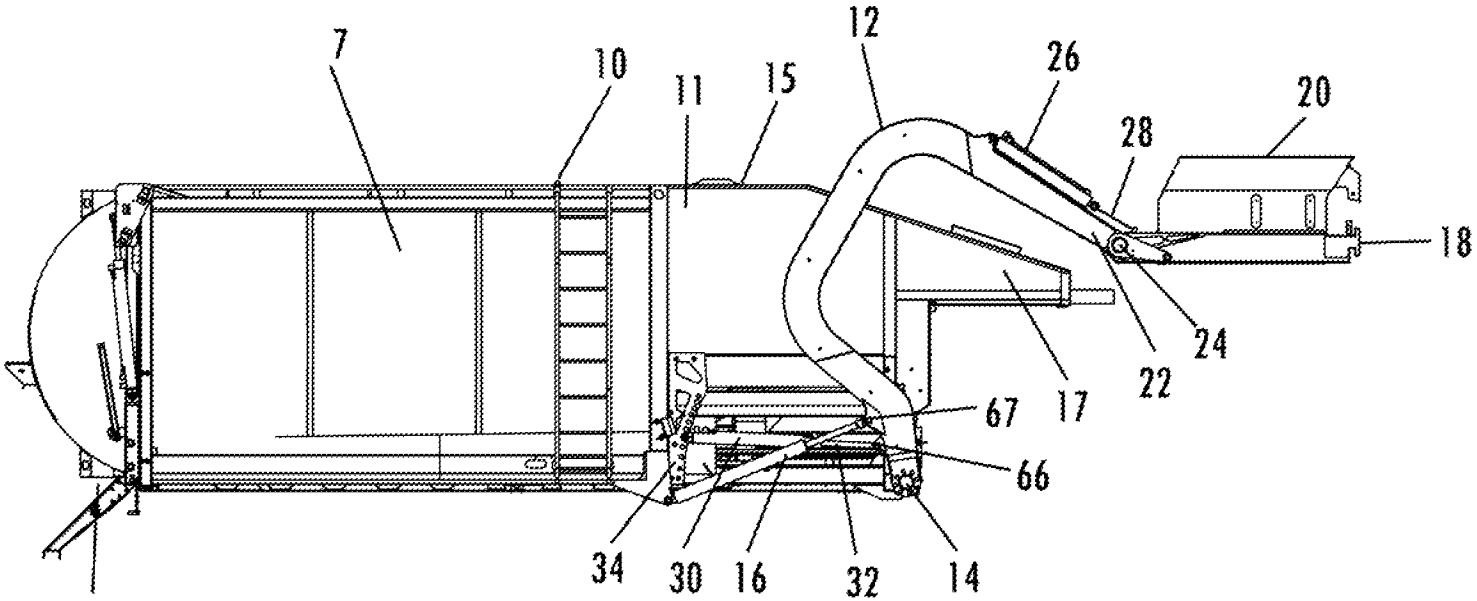
FIG. 1 is a side elevation of a front loading commodity collection body equipped with the present invention with a front intermediate container being lifted on the lift arms of the body.
Figure 2:
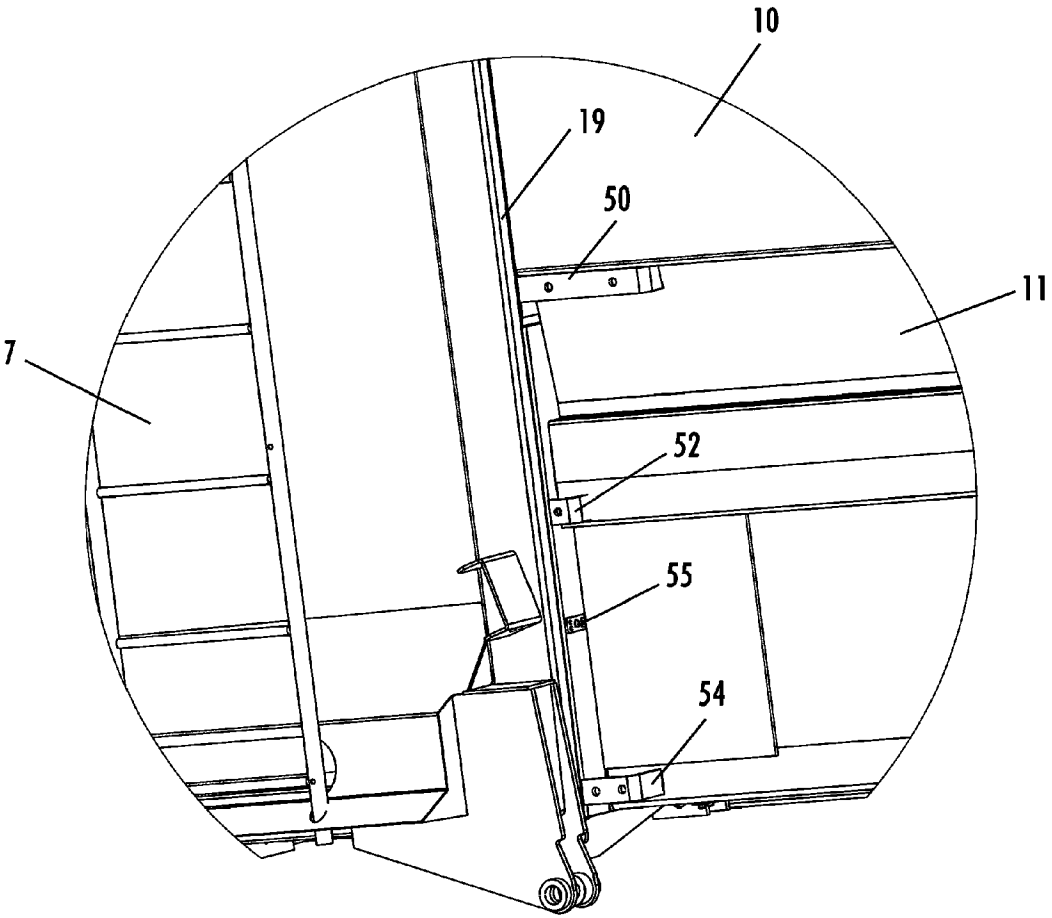
FIG. 2 is a close up perspective view of a part of the side of a commodity collection body which has been modified to receive retrofit apparatus to enable the body to automatically maintain the horizontal orientation of a container carried on the lift arms until the container is positioned for tipping over the load opening of the body.
Figure 3:
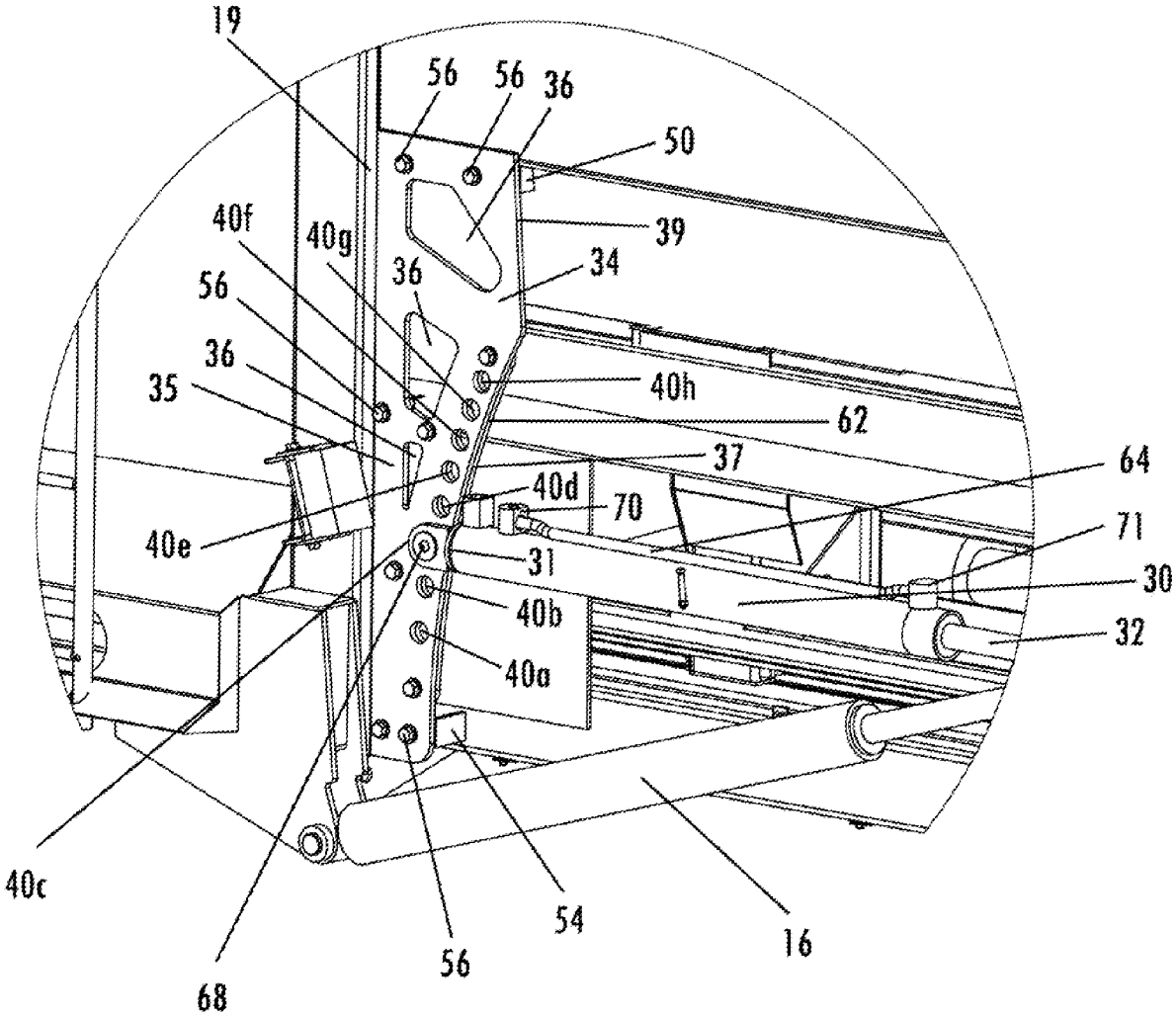
FIG. 3 is a close up perspective view of the invention mounted to the refuse body to retrofit it for the load leveling feature.

FIGS. 1-3 disclose a modification apparatus to be used to modify an existing front loading refuse collection truck so that the lifted container remains level until the container is near the load opening of the refuse collection body of the truck. The apparatus works entirely on hydraulic fluid movement and requires no extra controls to carry out proper load leveling. Addition of a multiposition mounting plate which mounts to one side of a conventional truck allows a slave cylinder to be added to a collection body to retrofit it with the leveling apparatus.

FIG. 1 discloses a conventional front loading refuse body 10 which has been modified with the apparatus of the present invention. The refuse body 10 is equipped with lift arms 12 which rotate about pivots 14 on opposing sides of the body 10. A pair of main hydraulic rams 16 on opposing sides of the body 10 raise and lower lift arms 12. The lift arms 12 are coupled to a platform 18 on which an intermediate container 20 is carried. The platform 18 is hinged to the free ends 22 of the lift arms 12 by pivot axle 24. The orientation of platform 18 and intermediate container 20 is controlled by load orienting cylinders 26 which are provided on lift arms 12 of the front loading refuse body 10. Load orienting cylinders 26 include rods 28 which retract and extend from load orienting cylinders 26 to control the rotation of platform 18 about pivot axle 24. The angle defined by platform 18 and lift arms 12 increases as the rods 28 extend.

In the conventional refuse truck, load orienting cylinders 26 are manually controlled by an operator controlling the extension or retraction of rods 28.

The current invention includes a slave cylinder 30 on one or the other side of the refuse body 10, the slave cylinder 30 having a rod 32 hinged to the lift arms 12 near pivot 14. The cylinder 30 is removably retained at its cap end 31 to a mounting plate 34 which is bolted or welded to refuse body 10. As the operator operates controls to cause arms 12 to pivot about pivot pin 14 up and over cab cover 17, the lift arms 12 raise intermediate container 20, while rod 32 is urged into slave cylinder 30 causing hydraulic fluid in slave cylinder 30 to be expelled and to flow to load orienting cylinders 26, causing load orienting cylinders 26 to extend rods 28, thereby rotating platform 18 clockwise around pivot axle 24 to maintain an upright orientation of intermediate container 20 until it is positioned near load opening 15. However, as lift arms 12 bring intermediate container 20 over compaction chamber 11 and above load opening 15, the truck operator intervenes to cause load orienting cylinders 26 to retract rods 28 thereby causing intermediate container 20 to rotate in a counterclockwise direction around pivot axle 24 to invert container 20 over load opening 15. Therefore, intermediate container 20 is maintained in a substantially upright orientation while it is lifted over cab cover 17 and then it is rotated to an inverted position as it moves to the dump position above load opening 15.

To employ the leveling apparatus, the operator closes the hydraulic valve for the load orienting cylinders 26, thereby placing the hydraulic lines from the slave cylinder 30 on the side of the collection body 10 in series with the load orienting cylinders 26 on the lift arms 12. As the rod 32 of the slave cylinder 30 retracts, fluid is expressed from the slave cylinder 30 and passed to the load orienting cylinders 26 causing their rods 28 to extend and to maintain a level orientation of the platform 18 on which the intermediate container 20 is carried. When the rod 32 of the slave cylinder 30 is fully retracted, the truck operator adjusts the hydraulic control valve manually to bypass the hydraulic lines from the slave cylinder 30 and to cause the load orienting cylinders 26 to retract, thereby rotating the intermediate container 20 into a substantially tipped position so that commodity in the container 20 will fall into the load opening 15 of the collection body. Once the hydraulic valve is closed again, as the slave cylinder 30 extends, the load orienting cylinders 26 retract.

Because mounting plate 34 includes multiple mounting points 40 (40*a*, 40*b* . . . 40*h*) for mounting of slave cylinder 30, the invention can easily be customized for a particular refuse collection body to be retrofitted with the invention.

Referring to FIG. 2, an area of the side of collection body 10 ready to receive the slave cylinder 30 is shown in an enlargement with main lift cylinder 16 omitted. Retrofit brackets 50, 52, 54 have been welded to the side of body 10 along the junction 19 between compaction chamber 11 and storage compartment 7. Retrofit brackets 50, 52 and 54 are located above pivot mount 19 of the main lift arm cylinder 16 and are positioned to receive mounting plate 34 as seen in FIG. 3. Hose clamp 55 may also be added. Therefore, it can be understood that the refuse body 10 in its original state need only be modified by the addition of retrofit brackets 50, 52, 54 to the exterior of compaction chamber 11.

Now concentrating attention on FIG. 3, an enlargement of mounting plate 34 at its mounting to refuse body 10 is provided. Mounting plate 34 is secured by bolts 56 to retrofit brackets 50, 52, 54 with a reinforcing plate 62 therebehind. Slave cylinder 30 has been securely connected at its cap end 31 to a selected one of mounting points 40*a*, 40*b*, 40*c*, 40*d*, 40*e*, 40*f*, 40*g*, 40*h*, selected to be appropriate to the travel of the lift arms 12 of the particular refuse body 10 being modified. Therefore mounting plate 34 may be used for a variety of front loading collection bodies. Hydraulic lines 64, diagrammatically shown in FIG. 3, are coupled to the interior of slave cylinder 30 and couple selectively to load orienting cylinders 26 in the lift arms 12. Rod 32 retracts into slave cylinder 30 as lift arms 12 lift container 20 and, as seen in FIG. 1, rod 32 is hinged to lift arm 12 at a connection tab 66 of lift arm 12. Tab 66 may be required to be added to lift arm 12 during installation of the invention.

Tab 66 is located between pivot 14 and ear 67 to which the rod of the main lift ram 16 is attached. This mounting for the rod 32 of slave cylinder 30 provides the proper proportional extension of rod 32 for the movement of lift arm 12 so that the slave cylinder 30 will properly control the extension of load orienting cylinders 26.

Mounting plate 34 is elongate and oriented generally vertically and attached to the side of refuse collection body 10 forward of the storage compartment 7 and above the pivot mount 19 of the collection body 10. Mounting plate 34 includes openings for receiving bolts 56 therethrough to retain mounting plate 34 to retrofit brackets 50, 52, 54. Mounting plate 34 includes a slightly concavely curved front edge 37 joined to a vertical upper front edge 39, with mounting points 40*a*, 40*b*, 40*c*, 40*d*, 40*e*, 40*f*, 40*g*, 40*h* disposed along curved edge 37. Voids 36 are cut into mounting plate 34 to reduce its weight. Mountings points 40*a*, 40*b*, 40*c*, 40*d*, 40*e*, 40*f*, 40*g*, 40*h* provide connections for attaching the cap end 31 of slave cylinder 30. A selected mounting point 40*c* is employed in the embodiment illustrated in FIG. 3 such that the mounting of cap end 31 of slave cylinder 30 thereto by bolt 68 through mounting point 40*c* will allow proper spacing from the lift arm 12 to which the rod 32 of slave cylinder 30 will be attached.

With the availability of multiple mounting points 40*a*, 40*b*, 40*c*, 40*d*, 40*e*, 40*f*, 40*g*, 40*h* on mounting plate 34, the mounting plate 34 and slave cylinder 30 can be fitted on a wide variety of sizes, makes and styles of front loading refuse body with only the addition of retrofit brackets 50, 52, 54 to the collection body to permit attachment of mounting plate 34 thereto.

The apparatus of the current invention may be used to modify a front loading commodity collection body having only operator control of the orientation of a container carried on the lift arms 12. The unmodified collection body 10 has a load leveling cylinder 26 mounted along each of the lift arms 12 The modification steps include: welding at least two mounting brackets 50, 54, and preferably also a third bracket 52 to a first lateral side of the compaction chamber 11 near its junction 19 with the storage compartment 7 of the commodity collection body 10, the brackets 50, 52, 54 having openings for receiving bolts 56 therein; bolting a mounting member 34 to the mounting brackets 50, 52, 54 by bolts 56. Then it may be necessary to weld a tab 66 to the lift arm 12 on the side with the mounting member 34, the tab 66 to be positioned between the main lift cylinder mounting ear 67 and the pivot 14 of the lift arm 12. Thereafter the cap end 31 of the slave cylinder 30 is attached to a selected one of the plural connection points 40*a*, 40*b*, 40*c*, 40*d*, 40*e*, 40*f*, 40*g* 40*h* based on the quantity of hydraulic fluid needed to cause both load leveling cylinders 26 to extend a given distance in response to a fixed distance of travel of the rod 32 of the slave cylinder 30. The rod 32 of the slave cylinder is attached to the tab by a hinge connection. Then a hydraulic line is coupled between first hydraulic connection 70 of the slave cylinder 30 and the extend hydraulic port of each of the load leveling cylinders 26. Second hydraulic connection 71 of the slave cylinder 30 is coupled to the retract hydraulic port of the each of the load leveling cylinders 26. Hydraulic fluid from the slave cylinder 30 exits through first hydraulic connection 70 when the rod 32 thereof is urged into the slave cylinder 30 by lift arm 12 and a first hydraulic hose transmits the fluid to the extend hydraulic port of each load leveling cylinder 26 to cause both load leveling cylinders 26 to extend and increase the angle between the lift arms 12 and the platform 18 on which the container 20 is attached. Hydraulic fluid from the slave cylinder 30 exits through second hydraulic connection 71 of the slave cylinder 30 when the rod 32 thereof is pulled from the slave cylinder 30 by the lift arm 12 and a second hydraulic hose transmits the fluid to the retract hydraulic port of each load leveling cylinder 26 to cause both load leveling cylinders 26 to retract and decrease the angle between the lift arms 12 and the platform 18. The attachment of the cap end 31 of the slave cylinder 30 to the selected mounting point 40*a*, 40*b*, 40*c*, 40*d*, 40*e*, 40*f*, 40*g*, 40*h* is determined by evaluating the quantity of displacement of hydraulic fluid per increment of extension distance of each load leveling cylinder 26, doubling that quantity, and determining the concomitant displacement of hydraulic fluid per incremental retraction of the rod 32 of the slave cylinder, and then selecting the appropriate mounting point 40*a*, 40*b*, 40*c*, 40*d*, 40*e*, 40*f*, 40*g*, 40*h* to use to fasten the cap end 31 of the slave cylinder 30. Experimentation may also be used to determine the proper mounting point 40*a*, 40*b*, 40*c*, 40*d*, 40*e*, 40*f*, 40*g*, 40*h* to be used.

From the above description, it should be understood that the invention may be easily added to various makes and models of front load refuse body to provide a leveling feature for a container carried on the lift arm 12, whether it be an intermediate container 20 carried on a platform 18 or a conventional fork pocket equipped front loadable refuse container.

While the present invention has been particularly shown and described with reference to exemplary embodiments thereof, it should be understood by those of ordinary skill in the art that various changes, substitutions and alterations can be made herein without departing from the scope of the invention as defined by appended claims and their equivalents. The invention can be better understood by reference to the following claims. For purpose of claim interpretation, the transitional phrases "including" and "having" are intended to be synonymous with the transitional phrase "comprising".

What is claimed is:

1. A front end load commodity collection body comprising lift arms driven by main hydraulic cylinders to lift a container supported on the lift arms from a ground position to a tipped position overlying a load opening of the body, the lift arms pivotable about pivots on opposing sides of the body, each of the main hydraulic cylinders hinged to a one of the opposing sides of the body and drivingly coupled to a one of the lift arms, a mounting member removably mounted to one of the sides of the collection body adjacent one of the main hydraulic cylinders, a slave cylinder mounted at a first end thereof to the mounting member, the slave cylinder hinged at a second end thereof to one of the lift arms wherein a rod of the slave cylinder extends or retracts in response to movement of the one of the lift arms, hydraulic ducts coupled to the slave cylinder and selectively coupled to leveling cylinders supported on the lift arms, the hydraulic ducts passing hydraulic fluid between the slave cylinder and the leveling cylinders when coupled thereto, rods of the leveling cylinders extending in response to hydraulic fluid received from the slave cylinder thereby maintaining an upright orientation of the container as the container is lifted.

2. The front end load commodity collection body of claim 1 wherein the mounting member is an elongate mounting plate, the elongate mounting plate vertically disposed, the elongate mounting plate including plural mountings therealong, the slave cylinder mounted at the first end thereof to a selected one of the plural mountings of the mounting plate.

3. The front end load commodity collection body of claim 2 wherein the mounting member comprises a concave front edge, the plural mounting positions disposed along the concave front edge.

4. The front end load commodity collection body of claim 1 wherein the slave cylinder is hinged at its second end to the lift arm between a hinged connection of a main lift cylinder and a pivot of the lift arm.

5. The front end load commodity collection body of claim 4 wherein the slave cylinder is hinged at its second end to a tab protruding from the lift arm, the tab located between the hinged connection of the main lift cylinder and the pivot of the lift arm.

6. The front end load commodity collection body of claim 1 wherein the container is supported on a platform hinged to free ends of the lift arms, an angle is defined by the platform and a one of the lift arms, the angle between the platform and the one of the lift arms increasing as the rods of the leveling cylinders extend from the leveling cylinders, each of the leveling cylinders supported upon a one of the lift arms adjacent the free end thereof.

7. The front end load commodity collection body of claim 1 wherein the mounting member is mounted above a hinge connection of a one of the main hydraulic cylinders to the collection body.

8. The front end load commodity collection body of claim 7 wherein the mounting member is an elongate mounting plate, the elongate mounting plate vertically disposed, the mounting member comprises a curved front edge, the elongate mounting plate including plural mountings therealong, the plural mounting positions disposed along the curved front edge, the slave cylinder mounted at the first end thereof to a selected one of the plural mountings of the mounting plate, the slave cylinder is hinged at its second end to a tab protruding from the lift arm between a hinged connection of a one of the main lift cylinders and a pivot of the lift arm on the collection body.

9. The front end load commodity collection body of claim 8 wherein the mounting plate is bolted to plural mounting brackets welded to the side of the collection body adjacent a junction of a compaction chamber of the collection body and a storage compartment thereof.

10. Retrofit apparatus for a front loading refuse collection body to provide load leveling of a load to be lifted by lift arms hinged to opposing sides of the collection body, comprising a mounting member removably mounted to one of the opposing sides of the refuse collection body, a slave cylinder hinged to the mounting member at a first end thereof, a second end of the slave cylinder hinged to one of the lift arms wherein a rod of the slave cylinder retracts or extends in response to movement of the one of the lift arms, the slave cylinder selectively coupled to leveling cylinders supported on the lift arms and hinged to the load, the leveling cylinders extending as the slave cylinder retracts in response to lifting movement of the lift arm, whereby the load supported on the lift arms may be maintained in an upright position as the load is raised to a load opening of the refuse collection body.

11. The retrofit apparatus of claim 10 wherein the mounting member is elongate and oriented generally vertically, the mounting member further comprising a series of connection points disposed along a front edge thereof, wherein a first end of a hydraulic cylinder may be coupled to a selected one of the connection points.

12. The retrofit apparatus of claim 10 further comprising a selectively operated valve coupled to hydraulic lines coupled to the hydraulic cylinder, the valve selectively coupling the hydraulic lines of the hydraulic cylinder to the leveling cylinders when the load is lifted to the load opening, the valve selectively decoupling the hydraulic lines from the leveling cylinders when the load is tipped over the load opening.

13. The retrofit apparatus of claim 10 further comprising valve means for interrupting the coupling of the slave cylinder to the leveling cylinders wherein an operator may selectively control retraction of the leveling cylinders.

14. The retrofit apparatus of claim 10 further comprising plural brackets are secured to the one of the sides, the brackets disposed adjacent a junction of a compaction chamber of the collection body and a storage compartment thereof.

15. The retrofit apparatus of claim 14 wherein the mounting member is elongate and oriented generally vertically, the mounting member further comprising a series of connection points disposed along a front edge thereof, wherein a first end of a hydraulic cylinder may be coupled to a selected one of the connection points, a selectively operated valve coupled to hydraulic lines coupled to the hydraulic cylinder, the valve selectively coupling the hydraulic lines of the hydraulic cylinder to the leveling cylinders when the load is lifted to the load opening, the valve selectively decoupling the hydraulic lines from the leveling cylinders when the load is tipped over the load opening.

16. A method to convert a front loading commodity collection body having only operator control of orientation of a container carried on a pair of lift arms, the collection body having a load leveling cylinder mounted along each of the lift arms, comprising the steps of:

welding at least two mounting brackets to a first lateral side of the commodity collection body, the brackets having openings for receiving bolts therein;

bolting a mounting member to the at least two brackets, the mounting member comprising a concave front edge and further comprising plural connection points along the front edge;

welding a tab to a first of the pair of lift arms, the tab positioned between a main lift cylinder mounting ear and a pivot of the lift arm;

attaching a cap end of a slave cylinder to a selected one of the plural connection points based on the quantity of hydraulic fluid needed to cause both lift cylinders to extend a given distance;

attaching a rod of the slave cylinder to the tab by a hinge connection;

coupling a first hydraulic connection of the slave cylinder to a first hydraulic port of each of the load leveling cylinders;

coupling a second hydraulic connection of the slave cylinder to a second hydraulic port of the each of the load leveling cylinders.

* * * * *